US008376833B1

(12) United States Patent
Gagner et al.

(10) Patent No.: US 8,376,833 B1
(45) Date of Patent: Feb. 19, 2013

(54) CONFIGURING AND CONTROLLING GAMING CONTESTS

(75) Inventors: Mark B. Gagner, West Chicago, IL (US); Brian D. Manning, Las Vegas, NV (US); Alfred Thomas, Las Vegas, NV (US)

(73) Assignee: WMS Gaming, Inc, Waukegan, IL (US)

( * ) Notice: Subject to any disclaimer, the term of this patent is extended or adjusted under 35 U.S.C. 154(b) by 0 days.

(21) Appl. No.: 13/295,058

(22) Filed: Nov. 12, 2011

Related U.S. Application Data

(60) Provisional application No. 61/412,981, filed on Nov. 12, 2010.

(51) Int. Cl.
*A63F 9/24* (2006.01)

(52) U.S. Cl. ..... 463/20; 463/16

(58) Field of Classification Search ..... 463/16–20, 463/25–42; 273/192, 292, 138.1, 143 R
See application file for complete search history.

(56) References Cited

U.S. PATENT DOCUMENTS

| | | | | |
|---|---|---|---|---|
| 7,500,913 | B2 * | 3/2009 | Baerlocher | 463/16 |
| 7,654,896 | B2 * | 2/2010 | Baerlocher | 463/16 |
| 7,713,124 | B2 * | 5/2010 | Cuddy et al. | 463/26 |
| 7,753,783 | B2 * | 7/2010 | Cuddy et al. | 463/28 |
| 7,857,699 | B2 | 12/2010 | Baerlocher | |
| 2008/0102920 | A1 | 5/2008 | Baerlocher | |
| 2010/0120525 | A1 * | 5/2010 | Baerlocher et al. | 463/29 |
| 2010/0291991 | A1 * | 11/2010 | Baerlocher et al. | 463/20 |
| 2011/0077071 | A1 | 3/2011 | Decasa et al. | |

FOREIGN PATENT DOCUMENTS

| | | |
|---|---|---|
| EP | 2038855 | 3/2009 |
| WO | WO-2004022181 | 3/2004 |
| WO | WO-2005025695 | 3/2005 |
| WO | WO-2007149180 | 12/2007 |

* cited by examiner

*Primary Examiner* — Masud Ahmed
(74) *Attorney, Agent, or Firm* — DeLizio Gilliam, PLLC

(57) ABSTRACT

A wagering game system and its operations are described herein. In some embodiments, the operations can include receiving, via user input, values for variables related to a wagering game contest and detecting data for gaming activity that occurred, during a past time period. The operations can further include computing an expected value based on the values for the variables and the data for the gaming activity. The expected value represents a theoretical projected amount of money that would be accumulated via a portion of game wagers over a future time period based on the values for the variables and the data for the gaming activity that occurred during the past time period. The operations can further include funding the wagering game contest with a contest prize equivalent to the expected value, where the funding is from a source of money other than from the portion of the game wagers.

24 Claims, 9 Drawing Sheets

701

EXAMPLE FORMULA FOR VIRTUAL EV

GAMING ACTIVITY VARIABLES

USER SPECIFIED VARIABLES

VIRTUAL E V = AVERAGE BET (PAST) X AVG. # OF GAMES (PAST) X DURATION PERIOD FOR GAMES (FUTURE) X VIRTUAL RAKE %

EXAMPLE CALCULATION USING FORMULA FOR VIRTUAL EV

VIRTUAL EV VALUE = ($.60/GAME) X (104 GAMES/MINUTE) X (120 MINUTES) X (.02) = $150

702 704 706 708 710

FIG. 7

CONFIGURING AND CONTROLLING GAMING CONTESTS

RELATED APPLICATIONS

This application claims the priority benefit of U.S. Provisional Application Ser. No. 61/412,981 filed Nov. 12, 2010.

LIMITED COPYRIGHT WAIVER

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2011, WMS Gaming, Inc.

TECHNICAL FIELD

Embodiments of the inventive subject matter relate generally to wagering game systems and networks that, more particularly, configure and control gaming contests.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

BRIEF DESCRIPTION OF THE DRAWING(S)

Embodiments are illustrated in the Figures of the accompanying drawings in which:

FIGS. 4-7 are illustrations of receiving values for a plurality of variables for a gaming contest, via user inputs, and calculating a virtual expected value based on the plurality of variables and data for gaming activity, according to some embodiments;

DESCRIPTION OF ILLUSTRATIVE EMBODIMENTS

This description of the embodiments is divided into six sections. The first section provides an introduction to embodiments. The second section describes example operating environments while the third section describes example operations performed by some embodiments. The fourth section describes additional example embodiments while the fifth section describes additional example operating environments. The sixth section presents some general comments.

Introduction

This section provides an introduction to some embodiments.

A casino is interested in providing any type of feature that makes their establishment unique or preferred. For instance, in an attempt to promote good will and to entice player loyalty, some casinos provide complimentaries, or "comps" to some patrons. Complimentaries are free items that the casino gives to its customers as a reward for their business. Complimentaries are typically funded by a casino's promotional budget. Complimentaries typically include promotional or marketing items, such as free hats and pens. Complimentaries may also include free food, free room, free beverages, etc. Some casinos also provide contests, such as raffles, which are funded by promotional dollars.

Casinos, however, are cautious about giving complimentaries or having promotional contests that are funded directly from gaming wagers. Many jurisdictional rules and regulations, as well as accounting complexities or tax implications, arise when funding a casino contest directly from game wagers. Some types of wagering games, called progressives, create a contest that takes a portion of wagers and puts the portions into a pot that a player can win as a jackpot. However, casinos do not themselves fund those games, but rather the funds that are taken from the wagers are held in trust for a game player and must be paid out to a player, according to many jurisdictional rules and regulations. Therefore, a casino's options for providing its own funds for a contest or promotion are limited to giving away complimentaries, having a raffle, etc.

Some embodiments of the inventive subject matter, however, provide a way for casino operators to calculate a projected, or theoretical, amount of money (a "virtual expected value") that the casino would have earned from game wagers for a given period of time, withdraw an amount of money equivalent to the virtual expected value from a source of funds that are not funded by game wagers (e.g., from a promotional account), and utilize the amount of money as a prize for a gaming contest. Further, some embodiments utilize features of wagering games and wagering game machines (e.g., gaming displays, gaming elements, gaming events, etc.) for the gaming contest, but do not extract money from wagers made for the wagering games or from the wagering game machines to fund the gaming contest.

Figure 1:
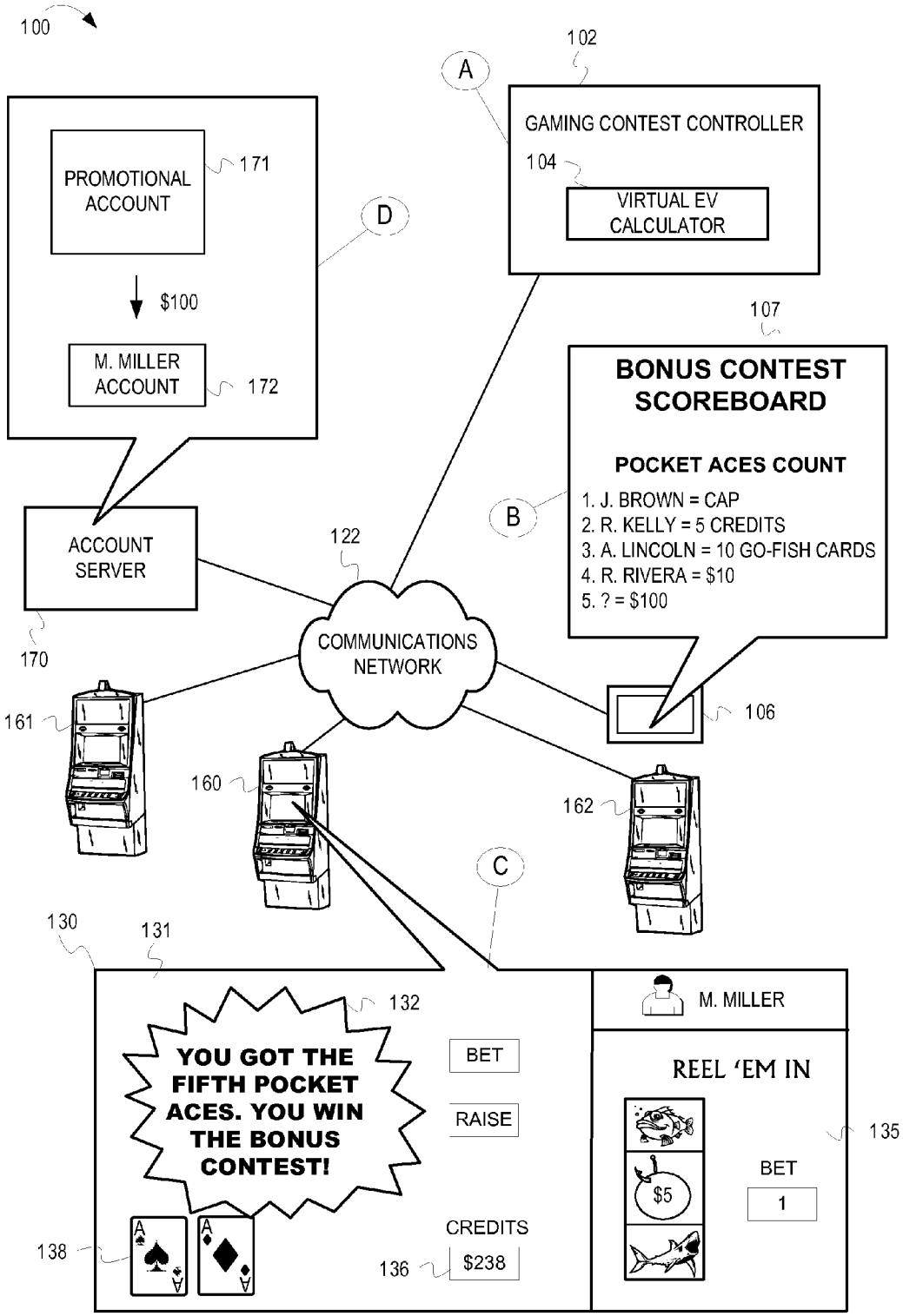
FIG. 1 is an illustration of configuring wagering game contests based on virtual expected values and funding the wagering game contests via a non-wager fund source, according to some embodiments.

FIG. 1 is a conceptual diagram that illustrates an example of configuring wagering game contests based on virtual expected values and funding the wagering game contests via a non-wager fund source, according to some embodiments. In FIG. 1, a wagering game system ("system") 100 includes a gaming contest controller 102 connected to an account server 170, wagering game machines 160, 161, and 162, and a presentation device 106 via a communications network 122. The wagering game machines 160, 161, and 162 are inside a casino and present wagering games. For example, wagering game machine 160 presents, via a display 130, a primary wagering game 131 and a secondary wagering game 135.

The gaming contest controller 102 receives input from a casino operator (e.g., an administrative user). The input can include various values that relate to variables of a gaming contest. For example, the variables can be used to determine a theoretical amount of money (virtual EV) that could be accumulated if portions, or contributions, of wagers were to be taken from one or more wagering games played in a casino (e.g., from wagering games played on the wagering game machines 160, 161 and 162). In other words, the virtual EV is a projected value that a casino would have earned via game play from wagers placed at the wagering game machines 160, 161, or 162 the values of the variables. The variables may include a duration that a gaming contest runs, a theoretical percentage of money taken from the wagers, specific gaming contest parameters, past gaming conditions, etc. The past gaming conditions may be, for example, an average amount of bets placed per machine for a past time period, an average number of active machines for a past time period, etc. The specific gaming contest parameters may include wagering game events that trigger a winning outcome for the gaming contest. The triggers or events occur via the wagering game machines 160, 161, or 162 (e.g., events that occur as a result of activity from the wagering game machines 160, 161, 162, events associated with games played on the wagering game machines 160, 161, 162, events that are presented using the wagering game machines 160, 161, 162, etc.).

At stage "A," using the values for the variables described above, the gaming contest controller 102 can calculate a value for the virtual EV and initiate a gaming contest that has a prize value equivalent to the value for the virtual EV. The gaming contest controller 102 can utilize a virtual EV calculator 104 to calculate the virtual EV. The prize value for the gaming contest, however, is not taken from wagers of wagering games. Instead, the gaming contest controller 102 allocates an amount of promotional funds from a promotional account 171 equivalent to the virtual EV. FIGS. 3 through 7 below illustrate further examples of calculating a virtual EV.

At stage "B," the gaming contest controller 102 tracks and analyzes gaming activity that occurs on the wagering game machines 160, 161, or 162 for the specific triggers or events associated with the gaming contest. The gaming contest controller 102 can also, at stage "B," present indications on a display 107 of a presentation device 106. The indications on the display 107 indicate wagering game players for, or to, which one or more of the triggers of the gaming contest occurred via the wagering game machines 160, 161, or 162. For example, the gaming contest controller 102 can track some "minor" win events, or count a number of events that occur before a "big" win event occurs. For instance, the gaming contest controller 102 can specify, as a condition of the gaming contest, that the fifth player to receive pair of pocket aces during poker games played at any of the wagering game machines 160, 161, 162 (or other wagering game machines in a casino network), will win the gaming contest. The gaming contest controller 102 can post on the display 107 the players that attain that pocket aces in order. As each player receives pocket aces, the system can provide "minor" win prizes that are also funded by the promotional account 171. The value of the minor prizes can be subtracted from the virtual EV. For instance, the EV calculator 104 may have projected a virtual EV of $150 and allocated the $150 from the promotional account 171 as the prize for the gaming contest. The gaming contest controller 102 can divide the $150 and award portions of the $150 in cash or other prizes (e.g., the first player to get pocket aces wins a cap, a second player to get pocket aces wins five game credits, a third player to get pocket aces wins ten entries for a long-standing bonus game, the fourth player to get pocket aces wins $10, and the fifth player will win $100, where the cap, the five game credits, the ten entries, the $10, and the $100, have an equivalent value of $150).

At stage "C," the gaming contest controller 102 can verify that a final trigger or event (e.g., a major "winning" trigger) occurs to, or at, one of the wagering game machines 160, 161, or 162. For example, a player that plays at the wagering game machine 160 is the fifth player, since the gaming contest began, to get a pair of pocket aces (i.e., the two "Ace" cards 138 assigned to the player of the primary wagering game 131 during one hand of poker). The gaming contest controller 102 presents a message (e.g., congratulatory message 132) that indicates that a player at the wagering game machine 160 just won the gaming contest.

At stage "D," the gaming contest controller 102 debits, or withdraws, an amount of funds from the promotional account 171 and credits, or deposits, the amount of the funds into a player account for the winner of the gaming contest (e.g., withdraws one-hundred dollars ($100) from the promotional account 171 and deposits the amount into the player account 172 that belongs to the player "M. Miller" logged in to the wagering game machine 160). The gaming contest controller 102 may also withdraw smaller amounts, or provide other prizes, to other player accounts, from the promotional account 171, for the "minor" prizes (i.e., for the first to fourth occurrences of the pocket aces since the gaming contest began). The wagering game machine 160 can update a credit balance for the player account 172, as indicated by the credit meter 136.

Further, even though the funds for the gaming contest are not from game wagers, the gaming contest controller 102 can utilize features of wagering game applications, wagering game machines, or other gaming network elements. For example, at stage "C," the gaming contest controller 102 detected that a gaming element (e.g., the cards 138 presented in the primary wagering game 131) presented a specific value or configuration. Further, at stage "C," the gaming contest controller 102 presented the congratulatory message 132 via the display 130 on the wagering game machine 160. The display 130 may be a graphical user interface, a window, a shared display area, etc. associated with the primary wagering game 131 or the secondary wagering game 135. Further, the gaming contest controller 102 updated the credit meter 136 that shows the account balance for the player account 172. The game elements for the primary wagering game 131, the display 130, and the credit meter 136 are all part of, or integrated with, the primary wagering game 131 or the wagering game machine 160.

Further, some embodiments of the inventive subject matter describe examples of configuring and controlling gaming contests in a network wagering venue (e.g., an online casino, a wagering game website, a wagering network, etc.) using a communication network, such as the communications network 122 in FIG. 1. Embodiments can be presented over any type of communications network that provides access to wagering games, such as a public network (e.g., a public wide-area-network, such as the Internet), a private network (e.g., a private local-area-network gaming network), a file sharing network, a social network, etc., or any combination of networks. Multiple users can be connected to the networks via computing devices. The multiple users can have accounts that subscribe to specific services, such as account-based wagering systems (e.g., account-based wagering game websites, account-based casino networks, etc.).

Further, in some embodiments herein a user may be referred to as a player (i.e., of wagering games), and a player may be referred to interchangeably as a player account. Account-based wagering systems utilize player accounts when transacting and performing activities, at the computer level, that are initiated by players. Therefore, a "player account" represents the player at a computerized level. The player account can perform actions via computerized instructions. For example, in some embodiments, a player account may be referred to as performing an action, controlling an item, communicating information, etc. Although a player, or person, may be activating a game control or device to perform the action, control the item, communicate the information, etc., the player account, at the computer level, can be associated with the player, and therefore any actions associated with the player can also be associated with the player account. Therefore, for brevity, to avoid having to describe the interconnection between player and player account in every instance, a "player account" may be referred to herein in either context. Further, in some embodiments herein, the word "gaming" is used interchangeably with "gambling."

Although FIG. 1 describes some embodiments, the following sections describe many other features and embodiments.

Example Operating Environments

This section describes example operating environments and networks and presents structural aspects of some embodiments. More specifically, this section includes discussion about wagering game system architectures.

Wagering Game System Architecture

Figure 2:
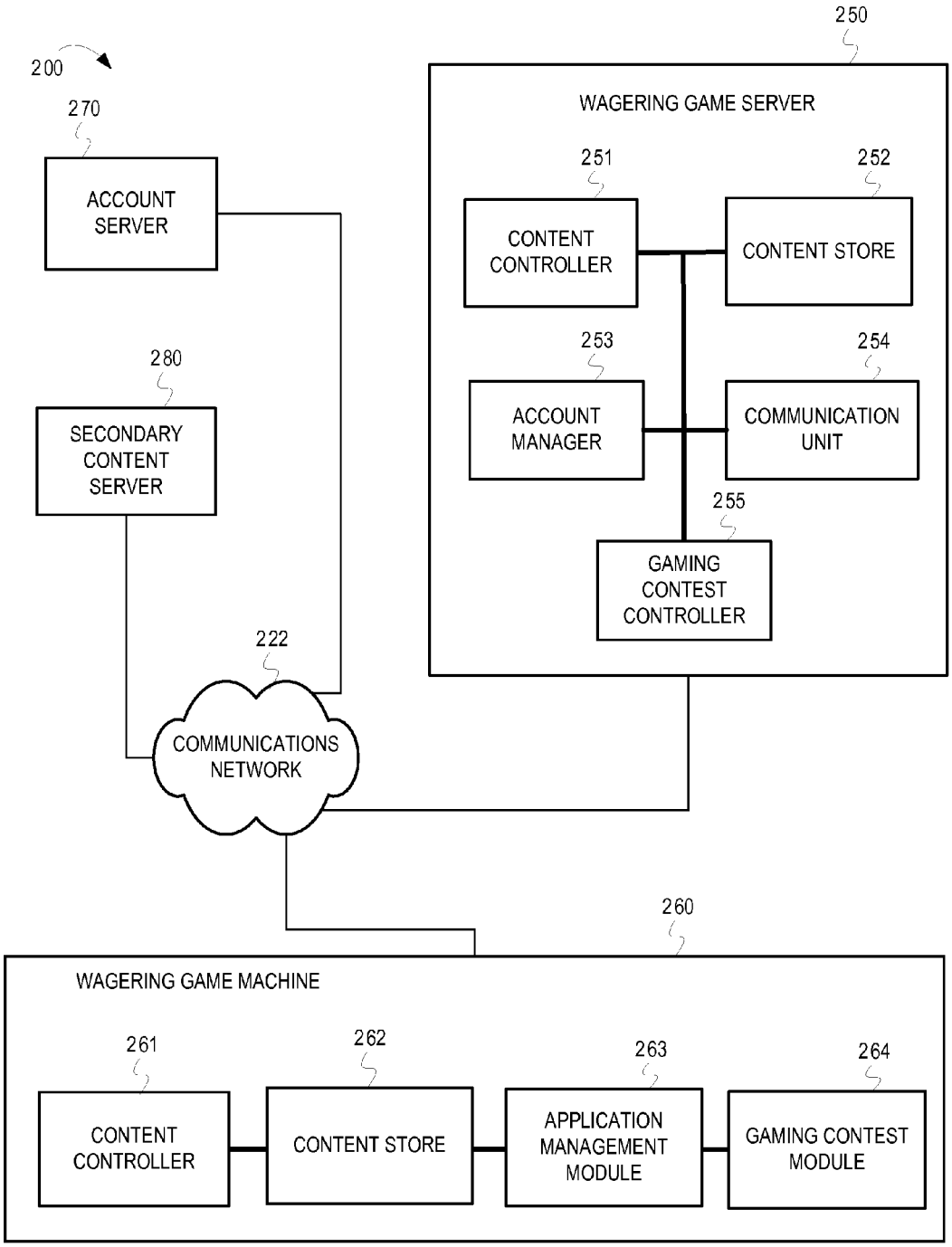
FIG. 2 is an illustration of a wagering game system architecture 200, according to some embodiments.

FIG. 2 is a conceptual diagram that illustrates an example of a wagering game system architecture 200, according to some embodiments. The wagering game system architecture 200 can include an account server 270 configured to control user related accounts accessible via wagering game networks and social networking networks. The account server 270 can store user account information, such as account settings (e.g., settings related to group games, settings related to social contacts, etc.), preferences (e.g., player preferences regarding gaming contests, account administrator preferences regarding gaming contests, etc.), player profile data (e.g., name, avatar, screen name, etc.), and other information for a wagering game account (e.g., financial information, account identification numbers, virtual assets, social contact information, promotional data, etc.). The account server 270 can contain lists of social contacts referenced by a user account. The account server 270 can also provide auditing capabilities, according to regulatory rules. The account server 270 can also track performance of players, machines, and servers.

The wagering game system architecture 200 can also include a wagering game server 250 configured to control wagering game content, provide random numbers, and communicate wagering game information, account information, and other information to and from a wagering game machine 260. The wagering game server 250 can include a content controller 251 configured to manage and control content for presentation on the wagering game machine 260. For example, the content controller 251 can generate game results (e.g., win/loss values), including win amounts, for games played on the wagering game machine 260. The content controller 251 can communicate the game results to the wagering game machine 260. The content controller 251 can also generate random numbers and provide them to the wagering game machine 260 so that the wagering game machine 260 can generate game results. The wagering game server 250 can also include a content store 252 configured to contain content to present on the wagering game machine 260. The wagering game server 250 can also include an account manager 253 configured to control information related to player accounts. For example, the account manager 253 can communicate wager amounts, game results amounts (e.g., win amounts), bonus game amounts, etc., to the account server 270. The wagering game server 250 can also include a communication unit 254 configured to communicate information to the wagering game machine 260 and to communicate with other systems, devices and networks. The wagering game server 250 can also include a gaming contest controller 255 configured to compute a virtual expected value for a gaming contest and fund the contest via a non-wager source of funds.

The wagering game system architecture 200 can also include the wagering game machine 260 configured to present wagering games and receive and transmit information to coordinate, present, and control portions of a gaming contest according to some embodiments. The wagering game machine 260 can include a content controller 261 configured to manage and control content and presentation of content on the wagering game machine 260. The wagering game machine 260 can also include a content store 262 configured to contain content to present on the wagering game machine 260. The wagering game machine 260 can also include an application management module 263 configured to manage multiple instances of gaming applications. For example, the application management module 263 can be configured to launch, load, unload and control applications and instances of applications. The application management module 263 can launch different software players (e.g., a Microsoft® Silverlight™ Player, an Adobe® Flash® Player, etc.) and manage, coordinate, and prioritize what the software players do. The application management module 263 can also coordinates instances of the server applications in addition to local copies of applications. The application management module 263 can control window locations on a wagering game screen or display for the multiple gaming applications. In some embodiments, the application management module 263 can manage window locations on multiple displays including displays on devices associated with and/or external to the wagering game machine 260 (e.g., a top display and a bottom display on the wagering game machine 260, a peripheral device connected to the wagering game machine 260, a mobile device connected to the wagering game machine 260, etc.). The application management module 263 can manage priority or precedence of client applications that compete for the same display area. For instance, the application management module 263 can determine each client application's precedence. The precedence may be static (i.e. set only when the client application first launches or connects) or dynamic. The applications may provide precedence values to the application management module 263, which the application management module 263 can use to establish order and priority. The precedence, or priority, values can be related to tilt events, administrative events, primary game events (e.g., hierarchical, levels, etc.), secondary game events, local bonus game events, advertising events, etc. As each client application runs, it can also inform the application management module 263 of its current presentation state. The applications may provide presentation state values to the application management module 263, which the application management module 263 can use to evaluate and assess priority. Examples of presentation states may include celebration states (e.g., indicates that client application is currently running a win celebration), playing states (e.g., indicates that the client application is currently playing), game starting states (e.g., indicates that the client application is showing an invitation or indication that a game is about to start), status update states (e.g., indicates that the client application is not 'playing' but has a change of status that should be annunciated, such as a change in progressive meter values or a change in a bonus game multiplier), idle states (e.g., indicates that the client application is idle), etc. In some embodiments, the application management module 263 can be pre-configurable. The system can provide controls and interfaces for operators to control screen layouts and other presentation features for the configuring the application management module 263. The application management module 263 can communicate with, and/or be a communication mechanism for, a base game stored on a wagering game machine. For example, the application management module 263 can communicate events from the base game such as the base game state, pay line status, bet amount status, etc. The application management module 263 can also provide events that assist and/or restrict the base game, such as providing bet amounts from secondary gaming applications, inhibiting play based on gaming event priority, etc. The application management module 263 can also communicate some (or all) financial information between the base game and other applications including amounts wagered, amounts won, base game outcomes, etc. The application management module 263 can also communicate pay table information such as possible outcomes, bonus frequency, etc.

In some embodiments, the application management module 263 can control different types of applications. For example, the application management module 263 can perform rendering operations for presenting applications of varying platforms, formats, environments, programming languages, etc. For example, the application management module 263 can be written in one programming language format (e.g., JavaScript, Java, C++, etc.) but can manage, and communicate data from, applications that are written in other programming languages or that communicate in different data formats (e.g., Adobe® Flash®, Microsoft® Silverlight™, Adobe® Air™, hyper-text markup language, etc.). The application management module 263 can include a portable virtual machine capable of generating and executing code for the varying platforms, formats, environments, programming languages, etc. The application management module 263 can enable many-to-many messaging distribution and can enable the multiple applications to communicate with each other in a cross-manufacturer environment at the client application level. For example, multiple gaming applications on a wagering game machine may need to coordinate many different types of gaming and casino services events (e.g., financial or account access to run spins on the base game and/or run side bets, transacting drink orders, tracking player history and player loyalty points, etc.). The wagering game machine 260 can also include a gaming contest module 264 configured to receive gaming contest control information from the gaming contest controller 255, present gaming contest content, and receive user input related to the gaming contest.

The wagering game system architecture 200 can also include a secondary content server 280 configured to provide content and control information for secondary games and other secondary content available on a wagering game network (e.g., secondary wagering game content, promotions content, advertising content, player tracking content, web content, etc.). The secondary content server 280 can provide "secondary" content, or content for "secondary" games presented on the wagering game machine 260. "Secondary" in some embodiments can refer to an application's importance or priority of the data. In some embodiments, "secondary" can refer to a distinction, or separation, from a primary application (e.g., separate application files, separate content, separate states, separate functions, separate processes, separate programming sources, separate processor threads, separate data, separate control, separate domains, etc.). Nevertheless, in some embodiments, secondary content and control can be passed between applications (e.g., via application protocol interfaces), thus becoming, or falling under the control of, primary content or primary applications, and vice versa. In some embodiments, the secondary content can be in one or more different formats, such as Adobe® Flash®, Microsoft® Silverlight™, Adobe® Air™, hyper-text markup language, etc. In some embodiments, the secondary content server 280 can provide and control content for community games, including networked games, social games, competitive games, or any other game that multiple players can participate in at the same time. In some embodiments, the secondary content server 280 can control and present an online website that hosts wagering games. The secondary content server 280 can also be configured to present multiple wagering game applications on the wagering game machine 260 via a wagering game website, or other gaming-type venue accessible via the Internet. The secondary content server 280 can host an online wagering website and/or a social networking website. The secondary content server 280 can include other devices, servers, mechanisms, etc., that provide functionality (e.g., controls, web pages, applications, etc.) that web users can use to connect to a social networking application and/or website and utilize social networking and website features (e.g., communications mechanisms, applications, etc.). The secondary content server 280 can also be configured to compute a virtual expected value for a gaming contest given user inputs and fund the contest via a non-wager source of funds. For example, the secondary content server 280 may include the gaming contest controller 255 in addition to, or instead of, the wagering game server 250. In some embodiments, the secondary content server 280 can also host social networking accounts, provide social networking content, control social networking communications, store associated social contacts, etc. The secondary content server 280 can also provide chat functionality for a social networking website, a chat application, or any other social networking communications mechanism. In some embodiments, the secondary content server 280 can utilize player data to determine marketing promotions that may be of interest to a player account. The secondary content server 280 can also analyze player data and generate analytics for players, group players into demographics, integrate with third party marketing services and devices, etc. The secondary content server 280 can also provide player data to third parties that can use the player data for marketing.

Each component shown in the wagering game system architecture 200 is shown as a separate and distinct element connected via a communications network 222. However, some functions performed by one component could be performed by other components. For example, the wagering game server 250 can also be configured to perform functions of the application management module 263, the secondary content server 280, and other network elements and/or system devices. Furthermore, the components shown may all be contained in one device, but some, or all, may be included in, or performed by, multiple devices, as in the configurations shown in FIG. 2 or other configurations not shown. For example, the account manager 253 and the communication unit 254 can be included in the wagering game machine 260 instead of, or in addition to, being a part of the wagering game server 250. Further, in some embodiments, the wagering game machine 260 can determine wagering game outcomes, generate random numbers, etc. instead of, or in addition to, the wagering game server 250.

The wagering game machines described herein (e.g., wagering game machine 260) can take any suitable form, such as floor standing models, handheld mobile units, bar-top models, workstation-type console models, surface computing machines, etc. Further, wagering game machines can be primarily dedicated for use in conducting wagering games, or can include non-dedicated devices, such as mobile phones, personal digital assistants, personal computers, etc.

In some embodiments, wagering game machines and wagering game servers work together such that wagering game machines can be operated as thin, thick, or intermediate clients. For example, one or more elements of game play may be controlled by the wagering game machines (client) or the wagering game servers (server). Game play elements can include executable game code, lookup tables, configuration files, game outcome, audio or visual representations of the game, game assets or the like. In a thin-client example, the wagering game server can perform functions such as determining game outcome or managing assets, while the wagering game machines can present a graphical representation of such outcome or asset modification to the user (e.g., player). In a thick-client example, the wagering game machines can determine game outcomes and communicate the outcomes to the wagering game server for recording or managing a player's account.

In some embodiments, either the wagering game machines (client) or the wagering game server(s) can provide functionality that is not directly related to game play. For example, account transactions and account rules may be managed centrally (e.g., by the wagering game server(s)) or locally (e.g., by the wagering game machines). Other functionality not directly related to game play may include power management, presentation of advertising, software or firmware updates, system quality or security checks, etc.

Furthermore, the wagering game system architecture 200 can be implemented as software, hardware, any combination thereof, or other forms of embodiments not listed. For example, any of the network components (e.g., the wagering game machines, servers, etc.) can include hardware and machine-readable storage media including instructions for performing the operations described herein.

Example Operations

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable storage media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram.

Figure 3:
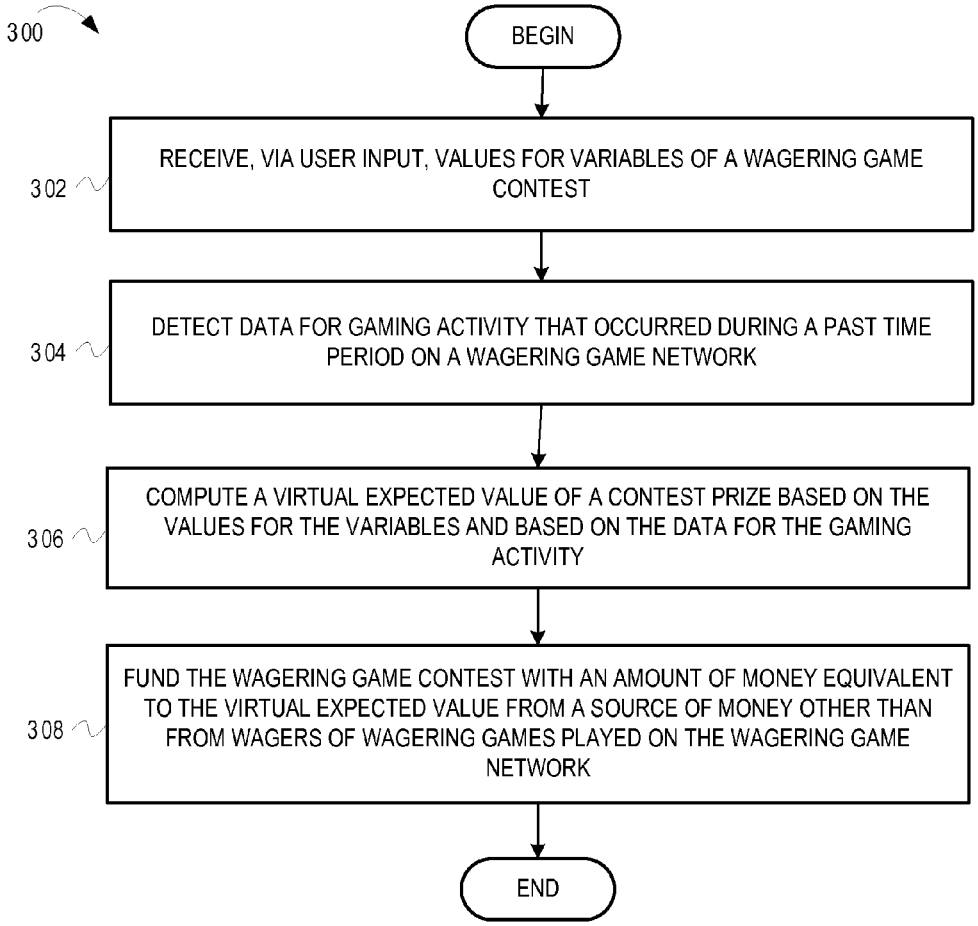
FIG. 3 is a flow diagram 300 illustrating configuring wagering game contests based on virtual expected values and funding the wagering game contests via a non-wager fund source, according to some embodiments.
Figure 4:
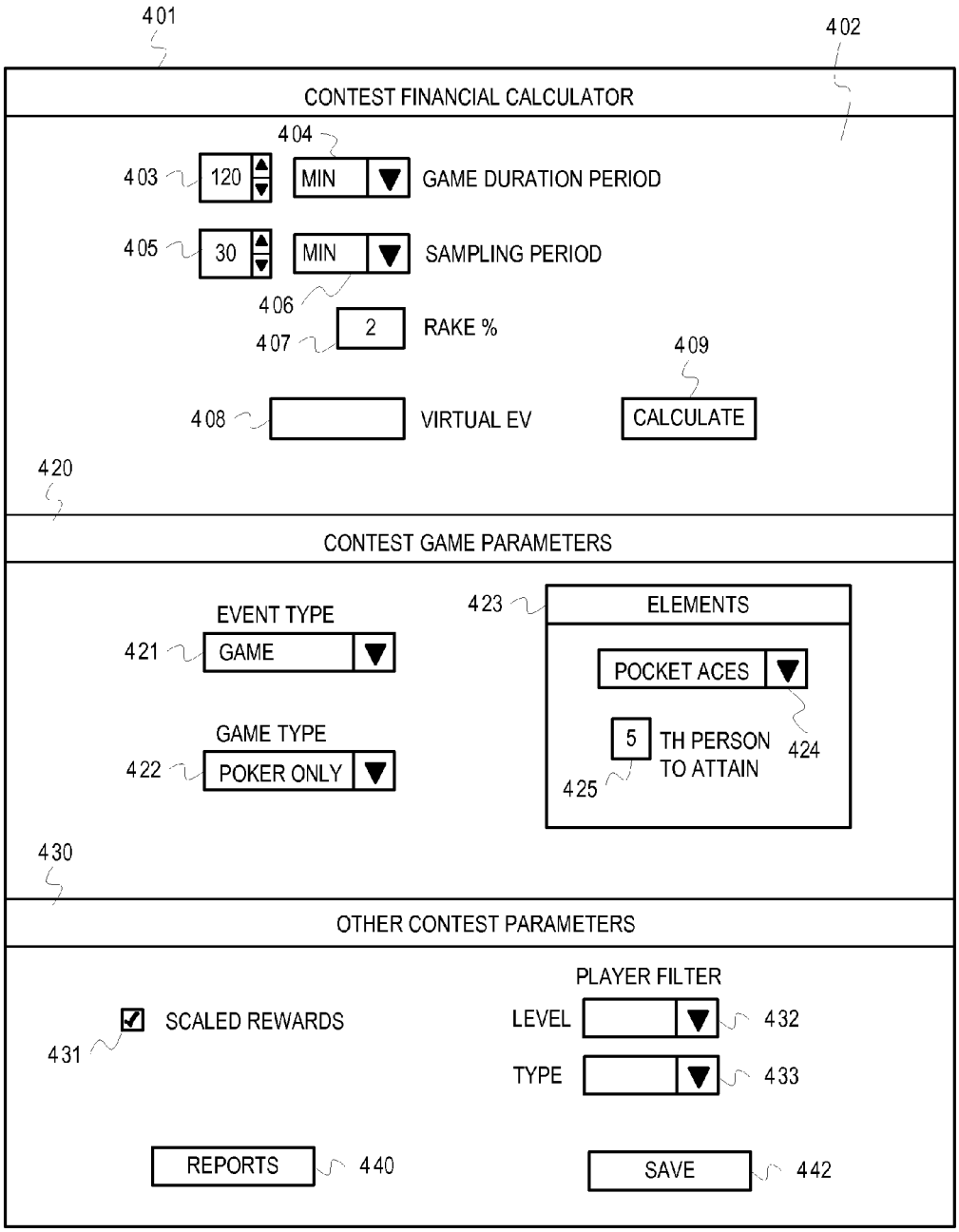
Figure 5:
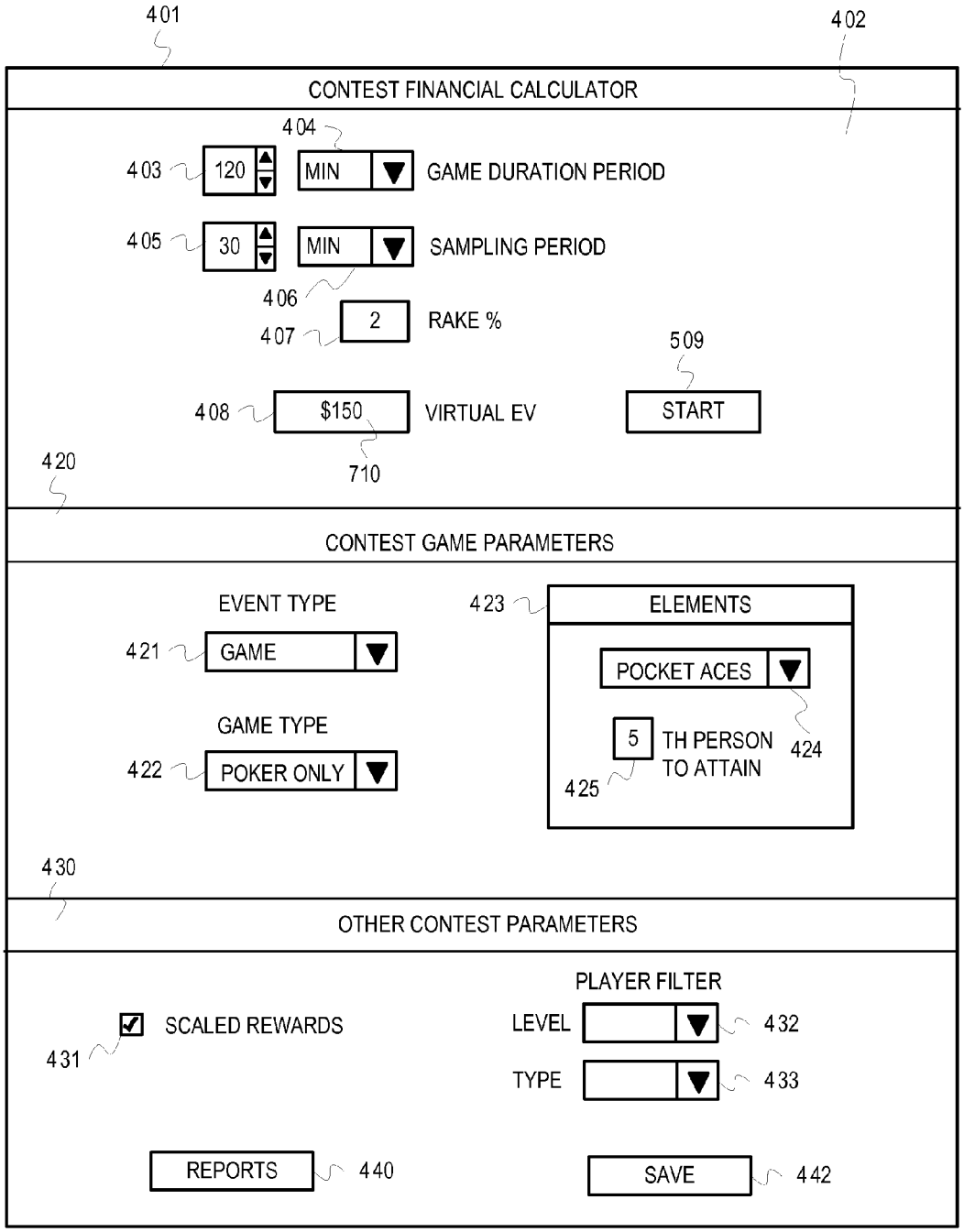
Figure 6:
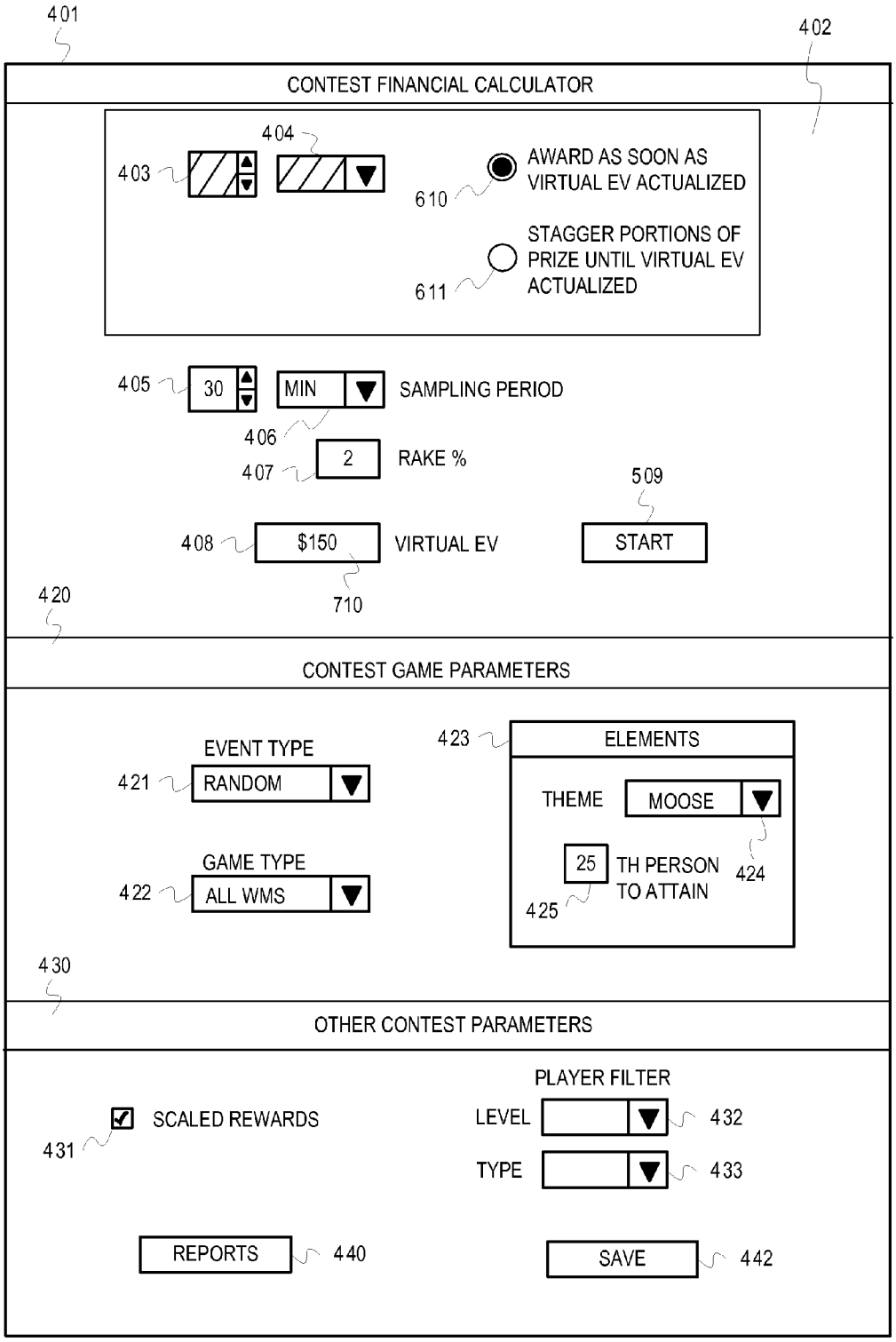

FIG. 3 is a flow diagram ("flow") 300 illustrating configuring wagering game contests based on virtual expected values and funding the wagering game contests via a non-wager fund source, according to some embodiments. FIGS. 4, 5, and 6 are conceptual diagrams that help illustrate the flow of FIG. 3, according to some embodiments. FIG. 3 will be described in concert with FIGS. 4, 5 and 6. In FIG. 3, the flow 300 begins at processing block 302, where a wagering game system ("system") receives, via user input, values for variables of a wagering game contest. The variables can represent or define parameters, or other game-specific criteria of the wagering game contest prior to a start of the wagering game contest, which can be used to compute a virtual expected value for the wagering game contest. For example, in FIG. 4, the system presents a graphical user interface 401 for configuring a wagering game contest that one or more patrons can later participate in when the patrons are in a casino. The graphical user interface 401 may also be referred to as a dashboard. The graphical user interface 401 includes a first section 402 for receiving a number of values associated with contest variables, a second section 420 for receiving specific gaming contest parameters, and a third section 430 for receiving other parameters associated with a gaming contest. The first section 402 includes elements of the graphical user interface 401 that can receive user input (e.g., receive typing of text, detect a clicking of a mouse button, load a file or profile, etc.) which specifies values for a number of variables used to determine an unanswered one of the variables. In other words, the first section 402 receives values for user-specified variables used to calculate some element, or parameter, of a gaming contest except one unknown variable value (i.e., of "N" variables for the contest, the first section can receives values for "N−1" of the user-specified variables). Given the "N−1" user-specified variable values, a calculator associated with the graphical user interface 401 calculates an estimated, or predicted, value for the one unknown variable value given the other variable values and existing gaming conditions. Some examples of user specified variables that can be specified via the first section 402 include (1) a contest duration (specified via contest duration controls 403 and 404), (2) a sampling period (specified via the sampling period controls 405 and 406), (3) a virtual rake percentage (specified via the virtual rake percentage control 407), and (4) a projected, or virtual, prize value (virtual EV) (specified via a virtual EV control 408). The following paragraphs further explain each of the examples of user specified variables that can be specified in the first section 402.

The contest duration variable relates to a duration amount ("contest time period") for the contest to run. In other words, the contest duration variable specifies a duration of time that would be estimated to transpire before a virtual EV would be attained via theoretical capture of portions of wagers. A casino operator can specify a numerical value for the contest time period via the first contest duration control 403 (e.g., specify the value of "120"). The casino operator can also specify a unit value via the second time duration control 404 (e.g., specify minutes, hours, days, etc.).

The sampling period variable is a duration setting that specifies a past period in which to sample a degree of gaming activity, or game conditions as they existed across a plurality of wagering game sessions that occurred on a wagering game network (e.g., sample an average bet per game or an average number of games over the past period). For example, a casino operator can specify a numerical value for the sample period via the first sampling period control 405 (e.g., specify the number "30). The casino operator can also specify, via the second sampling period control 406, a unit value (e.g., specify minutes, hours, days, etc.). In some embodiments, the sampling period can be a set number (e.g., a default value of the last 60 minutes). In some embodiments, the sampling period can mimic the duration specified in the contest duration controls 403 and 404. In some embodiments, the sampling period can be dynamically, and automatically, sampled from a most recent peak or lull in gaming activity on a casino network to a present time, or a time at which the virtual EV is calculated.

The virtual rake percentage variable represents a percent of gaming input dollars that would be required to be "raked" from game wagers for the gaming contest to attain the virtual EV given the contest time period. A casino operator can change the virtual rake percentage via the rake percentage control 407.

The virtual EV variable is a dollar amount of what a gaming contest would award if it were funded using the virtual rake percentage for the contest duration period given gaming activity data specified by the sampling period. An expected value (EV) is a value of an event (e.g., if there is a 1 in 10 chance of winning $1000, then the EV is one tenth of $1000, or $100). Thus, the virtual EV equates to an expected, or theoretical, amount of money that a game-funded contest would have taken out of the wagers of games over the contest time period, given the virtual rake percentage.

Returning momentarily to FIG. 3, the flow 300 continues at processing block 304, where the system detects data for gaming activity that occurred during a past time period on a wagering game network. For example, in FIG. 4, the contest duration controls 403 and 404 specify a value of one hour for a duration of the gaming contest, the sampling period controls 405 and 406 specify a sampling period of gaming activity over the last 30 minutes, and the rake percentage control 407 specifies a rake percentage value of two percent (2%). The system detects gaming activity for the past time period (i.e., for the last 30 minutes). Examples of gaming activity may include, for instance, (1) an average bet per game for the sampling period (e.g., average bet of $0.60 per game), and (2) an average rate of play for the sampling period (e.g., 10 games per minute).

The flow 300 continues at processing block 306, where the system computes a virtual EV of a contest prize based on the values for the variables and based on the data for the gaming activity. In FIG. 4, for instance, the system that presents the graphical user interface 401 controls a virtual EV calculator ("calculator") that can compute the values of the previously mentioned variables using data for specific gaming activity/conditions for the given sampling period. A calculation button 409 initiates the calculation. In one embodiment, the system may utilize the formula 701 specified in FIG. 7, where a value 702 of an average dollar amount per bet (e.g., $0.60/bet) is multiplied by a value 704 of an average number of games per minute (e.g., 104 games per minute), which is multiplied by a value 706 for the contest duration period (e.g., 120 minutes), which if further multiplied by a value 708 for the virtual rake percentage (e.g., 0.02 or 2%), which produces a value 538 for the virtual EV of approximately $150.

The system can initiate the gaming contest immediately, based on projected values. For example, in FIG. 5, the system calculates the value 710 of the virtual EV, and modifies the calculation button 409 to be a start button 509, which a casino operator can utilize to initiate the gaming contest. In some embodiments, the system can automatically run the gaming contest when the variable settings are satisfied. In other words, the system can wait and initiate the gaming contest when the value 710 of the virtual EV would have been earned/attained if funded by the games (e.g., wait for 120 minutes and check to see whether the value 710 of the virtual EV was earned before initiating the gaming contest).

Further, the second section 420 of the graphical user interface 401 includes additional controls to specify values of contest parameters that indicate events in wagering games that trigger one or more results of the gaming contest. The additional controls in the second section 420, for example, include an event type control 421 and a game type control 422. The event type control 421 can specify one of multiple types of events that result in a winning outcome of the gaming contest. The types of events may be, for example, one or more of the following:

Play dependent, wagering game events. Play dependent, wagering game events includes events that are dependent on a degree of game play or play performance. The events occur during wagering game play via wagering game content (e.g., as a result of specific configurations of game play elements). Examples of play dependent, wagering game events include, but are not limited to, a specific number of reel combinations that a player must attain over the contest period, a specific number of card hands that a player must receive over the contest period, a specific number of big wins the player must earn over the contest period, etc. Play dependent game events increase a player's chances of receiving a winning trigger to the gaming content for a player the longer the player plays.

Play independent, wagering game events. Play independent, wagering game events are events that are independent of a degree of game play or play performance, but still are generated via a wagering game, (e.g., being a fifth player to get pocket aces, being a tenth person to get a wild slot element, etc.,) which are equally as likely to occur for any player regardless of how long the player has been playing. In other words, the event that triggers the win in the gaming contest does not have to be based on any past wagering activity or performance. Instead, the chance to win the gaming contest can equal for all players when the system utilizes a play independent, wagering game event.

Random criteria. Some criteria can be random (e.g., a graphic pops up randomly on different player's screens, and a last player to touch the moose after a random number of touches or appearances, wins the gaming contest).

Other criteria (e.g., variations of any of the above listed criteria).

Elimination round. For example, in a round of poker, a player with the highest card may win the gaming contest. If, however, more than one player has the same highest card, then the determination of the winning trigger moves to the next round of hands using only those players that had the highest card in the previous round, and continues from round to round until one of the players obtains a high card and wins the gaming contest.

Lottery draw. A lottery draw is a drawing event from a group of entries. As a player plays wagering games, the player may earn multiple entries that are inserted into the group of entries for the lottery draw. The lottery draw is the winning event for the gaming contest. The multiple items may be earned over time, and may increase a player's chances of winning, however the winning event is selected at random from the group of entries.

Group activity. A group activity involves an event that multiple players can participate in and potentially win some, or all, of the contest prize. For example, a number of participants can draw 1 or more cards from a deck of card. The winning event for the gaming contest is a best five card hand from all the participants. Thus, a subset of the participants may win a portion of the gaming contest prize. If one player contributes a larger percentage of the cards in the five card hand, then the player may get more of the share. The group activity can occur over a period of time, (e/g/. the highest hand may change over the course of time). In other words, a player may need to be a participant in the highest number of highest hands over a period of time to win the gaming contest. The player's results over time can be displayed on a leader boards or other form of status display.

Referring still to FIG. 4, the second section 420 also includes a game type control 422. The game type control 422 receives user input that will expand the gaming contest across multiple types of games. The system can be programmed with math models and theoretical probabilities of a probable occurrence of a triggering event that could be used to determine an outcome for the gaming contest. As a result, the system can utilize the theoretical probability values and cater the contest to different players playing different games, but that may both be competing for the same prize in the gaming contest. For example, a first player may be playing a slot game and a second player may be playing a poker game. The gaming contest begins and the objective, or goal of the gaming contest is for the first player to experience a first event in their respective game before the second player experiences a second event in their respective game. However, the respective events are not the same. Rather, the probability of either occurring in either of the games is the same. For instance, in the slot game, when the gaming contest begins, the system may incorporate the first player and the second player into the gaming contest. The objective is for either (1) the first player to have a specific number of a specific slot-reel combinations occur within a specific amount of time (e.g., have five two-cherry groupings occur on a five-symbol slot reel within 25 minutes) or (2) the second player to have a specific number or type of poker hand (e.g., have 4 pocket pairs within 25 minutes). The system sets the different objectives for the first player and second player because the system knows that, based on game math models, for a standard rate of play for either game, the probability of either objective occurring within the 25 minutes is equivalent.

The second section 420 also includes a game element configuration section 423 with a game activity control 424 to specify a specific activity or configuration of gaming elements to occur during the gaming contest and a game condition control 425 to specify a condition about the specific activity or configuration of gaming elements. Using the game element configuration section 423, a casino operator, for example, could configure the wining event(s) that signify an outcome(s) to the gaming contest (e.g., specify that the fifth person to get pocket aces wins the gaming contest).

Furthermore, if the additional parameters are not selected in the second section 420 (e.g., the controls in the second section 420 are left blank), the system can show specific winning events/parameters that could be played on specific machines, for given types of games, etc. that would generate the proper virtual expected value, etc. For instance, if all of the values for the variables were entered in the first section 402, the second section 420 can sort event/criteria parameter given the values of the variables in the first section 402.

In some embodiments, the additional parameters entered in the second section 420 may affect a calculation of any of the variables in the first section 402. For instance, the values selected in the second section 420 may add one or more factors into the formula 701 indicated in FIG. 7. For example, given the probabilities of occurrence of the event(s) specified in the second section 420, the system may automatically generate, adjust, or limit one or more of the vales of the variables in the first section 402. In other words, depending on the uncertainty of the occurrence of specific events for winning criteria (i.e., depending on uncertainty of occurrence of events specified in the second section 420) the system may have difficulty computing a duration for the gaming contest (e.g., based on the uncertainty, one of the variables may become irrelevant, incalculable, biased, or misleading to a calculation formula, such as the formula 701 in FIG. 7.). As a result, the system may deactivate the contest duration controls 403 and 404, enforce minimum/maximum values or maximum values via the contest duration controls 403 and 404, etc. The gaming contest could then, for instance, run without a specified duration until the expected value was met, and once met, would trigger a winner. In another embodiment, instead of making an indeterminate duration for the gaming contest, the expected prize value could be indeterminate so that, after the set duration for the gaming contest, the gaming contest would only award a portion of money that would actually have been accumulated. In another embodiment, the system could award back-to-back contests for the same, or different amounts of durations, that keep giving away portions of the prize value until all of the prize value has all been given out. The system could have a lock-in feature before running any calculations to lock-in certain variables. The system could notify if one of the contest duration or the virtual EV value is indeterminate, and then run the calculation excluding the indeterminate variable.

The system may also modify a format for entering a value. For example, in FIG. 6, the second section 420 may have specified a random winning event that causes a graphic of an object (e.g., a moose) to pop up on players' displays as they play primary and/or secondary wagering games. As the players touch the graphic on their respective displays, the system counts down the number of touches until one player is the final person to touch the graphic (e.g., the $25^{th}$ player to touch the moose graphic), thus winning the contest. However, because the event is specified as being random, the system may not be able to accept a contest duration because the timing of the presentation of the moose object may not be known (i.e., randomly appears). Thus, in some embodiments, the system deactivates (e.g., grays out, removes, etc.) the contest duration controls 403 and 404 and instead specifies additional controls (e.g., radio buttons 610 and 611) that indicate whether to award a prize as soon as the virtual EV is actualized (e.g., as soon as the virtual EV is actually earned given the values for the variables and the gaming conditions), or whether to stagger portions of the prize until the virtual EV is actualized. In other embodiments, however, the system can leave the contest duration controls 403 and 404 active and the system can instead carefully time the presentation of the appearances of the moose objects to appear within the allotted time period (e.g., the $25^{th}$ appearance of the moose object occurs at the expiration of any value indicated in the contest duration controls 403 and 404). In some embodiments, the value in the contest duration controls 403 and 404 can modify the value in the second section 420 (e.g., can modify the amount of people to touch the moose object to comport with the duration value specified via the contest duration controls 403 and 404) or vice versa (e.g., can modify the duration value specified via the contest duration controls 403 and 404 to comport with the amount of people required to touch the moose object).

The flow 300 continues at processing block 308, where the system funds the contest with an amount of money equivalent to the virtual EV from a source of money other than from wagers of wagering games played on the wagering game network. The system can fund the game directly from the source of money when the gaming contest begins, ends, or throughout the duration of the gaming contest. In some embodiments, the source of money is a promotional, or marketing, account owned, or controlled, by a casino's administrative user(s). The promotional account can be linked to the system and directly accessed by the system.

Additional Example Embodiments

According to some embodiments, a wagering game system ("system") can provide various example devices, operations, etc., to configure and control gaming contests. The following non-exhaustive list enumerates some possible embodiments.

- In some embodiments, the system can require that a player be present to win a gaming contest (e.g., be in the casino between 5 PM to 7 PM).
- In some embodiments, the system can provide controls that indicate whether to stagger, or scale, the awards based on a number of events related to winning criteria. For example, in FIG. 4, in the third section 430, a checkbox 431 can be selected which indicates to the system to divide up the amount of the contest prize and provide it to multiple players.
- In some embodiments, the system can include controls that filter the gaming contest based on player characteristics. For example, in FIG. 4, in the third section 430, a player level control 432 can filter the gaming contest to be for only a specific level of player (e.g. a specific status level, a specific level of spending, a specific level of loyalty points, a specific degree of play, etc.). The third section 430 can also have a player type control 433 to filter the gaming contest to be for only a specific type of player (e.g., a player that plays a specific type of game, a player that has a specific demographic, a player that has registered for a specific loyalty program, a player that plays at a certain time of day, a player that likes specific types of shows, etc.). Based on the player characteristics (e.g., level or type of player) the system can adjust, or target, the contest prizes to be more specific to the characteristic of the player (e.g., provide food prizes for players that play at specific times of the day, provide room and/or board prizes for players that travel, etc.).
- In some embodiments, the system can refer to a player's history of play and use the player's history to calculate, or modify a calculation (e.g., add a factor to the formula 701 in FIG. 7 which compensates for the player's likelihood, based on the player's history, to attain the winning event within the duration of the gaming contest).
- In some embodiments, the system can conduct the gaming contest via a secondary gaming contest application or module ("secondary application") (e.g., a secondary application that runs in the background on a wagering game machine, a server-side application presented via a portion of a graphical user interface on a wagering game machine, etc.). The system can gather game activity data from a primary wagering game, or a secondary wagering game, via one or more integrated features (e.g., via an application programming interface) between the secondary application and the primary and/or secondary wagering games. In some embodiments, the gaming contest is based strictly on gaming activity that occurs in a secondary wagering game. The secondary application and the secondary wagering game may both be server-side applications controlled by the same server. Consequently, the server can easily control a transfer of data, a frequency of events, a degree of probabilities, etc. for both the server-side applications.
- In some embodiments, the system can announce in advance that a gaming contest is about to start to get people to sign up and get involved in the gaming contest.
- In some embodiments, the system can specify a trophy that will be incorporated into a player's profile when a player wins the gaming contest.
- In some embodiments, the system can integrate the gaming contest with environmental lighting and sound effects that are controlled on the wagering game network (e.g., integrated with DMX light shows).
- In some embodiments, the system can generate analytics and reports regarding the gaming contests. For instance, the system can generate a report that shows calculated theoretical variable values (calculated via the calculator application) to actual values that occurred. For instance, the system can indicate whether a virtual EV was actually attained over the duration of the gaming contest. In FIG. 4, for example, the graphical user interface 401 includes a reporting control 440 to launch and/or configure reports. Further, if the system runs multiple gaming contests, then, based on analysis and reports of the virtual EVs and actualized EVs, the system can automatically adjust the virtual EVs for future contests to be more or less biased toward a more generous or conservative virtual EV.
- In some embodiments, the system can save specific settings for a contest and reload the settings when desired. For example, in FIG. 4, the graphical user interface 401 includes a save button 442 that a casino administrator can utilize to save the values of variables, parameters, etc. specified in the graphical user interface 401. The system can also provide other controls to open previously saves settings.

Additional Example Operating Environments

This section describes example operating environments, systems and networks, and presents structural aspects of some embodiments.

Wagering Game Machine Architecture

Figure 8:
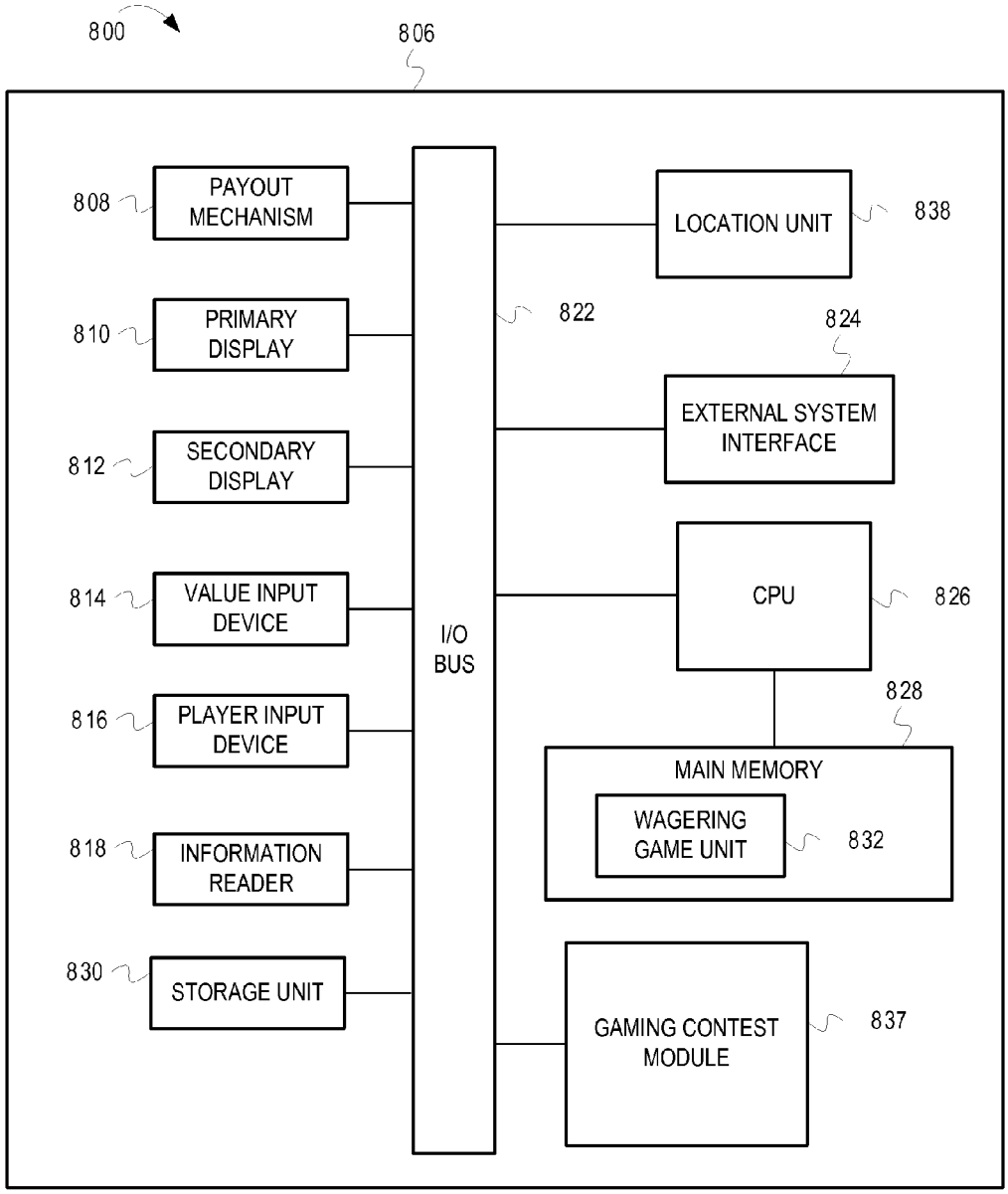
FIG. 8 is an illustration of a wagering game machine architecture 800, according to some embodiments.

FIG. 8 is a conceptual diagram that illustrates an example of a wagering game machine architecture 800, according to some embodiments. In FIG. 8, the wagering game machine architecture 800 includes a wagering game machine 806, which includes a central processing unit (CPU) 826 connected to main memory 828. The CPU 826 can include any suitable processor, such as an Intel® Pentium processor, Intel® Core 2 Duo processor, AMD Opteron™ processor, or UltraSPARC processor. The main memory 828 includes a wagering game unit 832. In some embodiments, the wagering game unit 832 can present wagering games, such as video poker, video black jack, video slots, video lottery, reel slots, etc., in whole or part.

The CPU 826 is also connected to an input/output ("I/O") bus 822, which can include any suitable bus technologies, such as an AGTL+ frontside bus and a PCI backside bus. The I/O bus 822 is connected to a payout mechanism 808, primary display 810, secondary display 812, value input device 814, player input device 816, information reader 818, and storage unit 830. The player input device 816 can include the value input device 814 to the extent the player input device 816 is used to place wagers. The I/O bus 822 is also connected to an external system interface 824, which is connected to external systems (e.g., wagering game networks). The external system interface 824 can include logic for exchanging information over wired and wireless networks (e.g., 802.11g transceiver, Bluetooth transceiver, Ethernet transceiver, etc.)

The I/O bus 822 is also connected to a location unit 838. The location unit 838 can create player information that indicates the wagering game machine's location/movements in a casino. In some embodiments, the location unit 838 includes a global positioning system (GPS) receiver that can determine the wagering game machine's location using GPS satellites. In other embodiments, the location unit 838 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 8, in some embodiments, the location unit 838 is not connected to the I/O bus 822.

In some embodiments, the wagering game machine 806 can include additional peripheral devices and/or more than one of each component shown in FIG. 8. For example, in some embodiments, the wagering game machine 806 can include multiple external system interfaces 824 and/or multiple CPUs 826. In some embodiments, any of the components can be integrated or subdivided.

In some embodiments, the wagering game machine 806 includes a gaming contest module 837. The gaming contest module 837 can process communications, commands, or other information, where the processing can configure and control gaming contests.

Furthermore, any component of the wagering game machine 806 can include hardware, firmware, and/or machine-readable storage media including instructions for performing the operations described herein.

Wagering Game Machine

Figure 9:
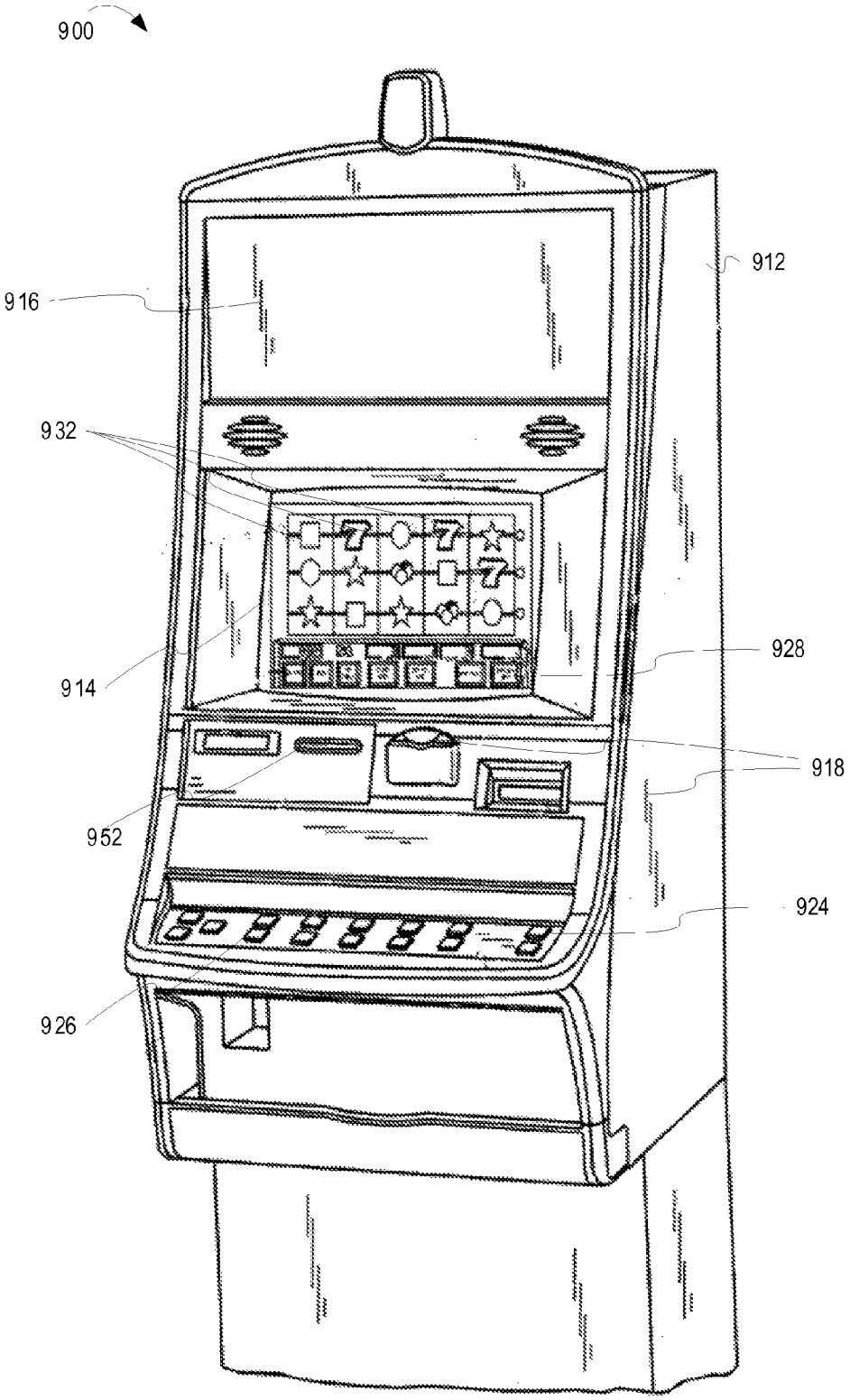
FIG. 9 is an illustration of a wagering game machine 900, according to some embodiments.

FIG. 9 is a conceptual diagram that illustrates an example of a wagering game machine 900, according to some embodiments. Referring to FIG. 9, the wagering game machine 900 can be used in gaming establishments, such as casinos. According to some embodiments, the wagering game machine 900 can be any type of wagering game machine and can have varying structures and methods of operation. For example, the wagering game machine 900 can be an electromechanical wagering game machine configured to play mechanical slots, or it can be an electronic wagering game machine configured to play video casino games, such as blackjack, slots, keno, poker, blackjack, roulette, etc.

The wagering game machine 900 comprises a housing 912 and includes input devices, including value input devices 918 and a player input device 924. For output, the wagering game machine 900 includes a primary display 914 for displaying information about a basic wagering game. The primary display 914 can also display information about a bonus wagering game and a progressive wagering game. The wagering game machine 900 also includes a secondary display 916 for displaying wagering game events, wagering game outcomes, and/or signage information. While some components of the wagering game machine 900 are described herein, numerous other elements can exist and can be used in any number or combination to create varying forms of the wagering game machine 900.

The value input devices 918 can take any suitable form and can be located on the front of the housing 912. The value input devices 918 can receive currency and/or credits inserted by a player. The value input devices 918 can include coin acceptors for receiving coin currency and bill acceptors for receiving paper currency. Furthermore, the value input devices 918 can include ticket readers or barcode scanners for reading information stored on vouchers, cards, or other tangible portable storage devices. The vouchers or cards can authorize access to central accounts, which can transfer money to the wagering game machine 900.

The player input device 924 comprises a plurality of push buttons on a button panel 926 for operating the wagering game machine 900. In addition, or alternatively, the player input device 924 can comprise a touch screen 928 mounted over the primary display 914 and/or secondary display 916.

The various components of the wagering game machine 900 can be connected directly to, or contained within, the housing 912. Alternatively, some of the wagering game machine's components can be located outside of the housing 912, while being communicatively coupled with the wagering game machine 900 using any suitable wired or wireless communication technology.

The operation of the basic wagering game can be displayed to the player on the primary display 914. The primary display 914 can also display a bonus game associated with the basic wagering game. The primary display 914 can include a cathode ray tube (CRT), a high resolution liquid crystal display (LCD), a plasma display, light emitting diodes (LEDs), or any other type of display suitable for use in the wagering game machine 900. Alternatively, the primary display 914 can include a number of mechanical reels to display the outcome. In FIG. 9, the wagering game machine 900 is an "upright" version in which the primary display 914 is oriented vertically relative to the player. Alternatively, the wagering game machine can be a "slant-top" version in which the primary display 914 is slanted at about a thirty-degree angle toward the player of the wagering game machine 900. In yet another embodiment, the wagering game machine 900 can exhibit any suitable form factor, such as a free standing model, bar top model, mobile handheld model, or workstation console model.

A player begins playing a basic wagering game by making a wager via the value input device 918. The player can initiate play by using the player input device's buttons or touch screen 928. The basic game can include arranging a plurality of symbols 932 along a pay line, which indicates one or more outcomes of the basic game. Such outcomes can be randomly selected in response to player input. At least one of the outcomes, which can include any variation or combination of symbols, can trigger a bonus game.

In some embodiments, the wagering game machine 900 can also include an information reader 952, which can include a card reader, ticket reader, bar code scanner, RFID transceiver, or computer readable storage medium interface. In some embodiments, the information reader 952 can be used to award complimentary services, restore game assets, track player habits, etc.

Embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments of the inventive subject matter may take the form of a computer program product embodied in any tangible medium of expression having computer readable program code embodied in the medium. The described embodiments may be provided as a computer program product, or software, that may include a machine-readable storage medium having stored thereon instructions, which may be used to program a computer system (or other electronic device(s)) to perform a process according to embodiments(s), whether presently described or not, because every conceivable variation is not enumerated herein. A machine-readable storage medium includes any mechanism that stores information in a form readable by a machine (e.g., a wagering game machine, computer, etc.). For example, machine-readable storage media includes read only memory (ROM), random access memory (RAM), magnetic disk storage media, optical storage media (e.g., CD-ROM), flash memory machines, erasable programmable memory (e.g., EPROM and EEPROM); etc. Some embodiments of the invention can also include machine-readable signal media, such as any media suitable for transmitting software over a network.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. A computer-implemented method comprising:

receiving, via user input, values for variables related to a wagering game contest, wherein the variables define parameters of the wagering game contest prior to initiation of the wagering game contest;

detecting data for gaming activity that occurred during a past time period via a plurality of wagering game sessions conducted via game play of a plurality of wagering games, wherein at least one of the values for the variables indicates the past time period;

computing, via one or more processors, an expected value of an award for the wagering game contest based on the values for the variables and the data for the gaming activity, wherein the expected value represents a theoretical projected amount of money that would be accumulated via a portion of game wagers over a future time period based on the values for the variables and the data for the gaming activity that occurred during the past time period; and funding, via at least one of the one or more processors, the award for the wagering game contest with an amount of money equivalent in value to the expected value, wherein the funding is from a source of money other than from the portion of the game wagers.

2. The computer-implemented method of claim 1, wherein the variables comprise one or more of a gaming contest duration that specifies the future time period, a virtual rake percentage that specifies the portion of the game wagers, and a sampling period that specifies the past time period for the detecting of the data for the gaming activity.

3. The computer-implemented method of claim 1, wherein the variables comprise one or more events that trigger an outcome for the wagering game contest.

4. The computer-implemented method of claim 3 further comprising:

automatically modifying one or more of the values for the variables based on the one or more events.

5. The computer-implemented method of claim 1, wherein the data for the gaming activity comprises one or more of an average number of games played over the past time period, and an average bet amount per game over the past time period.

6. One or more machine-readable storage media having instructions stored thereon, which when executed by a set of one or more processors causes the set of one or more processors to perform operations comprising:

receiving, via user input, values for variables related to a wagering game contest;

detecting data for gaming activity that occurred, during a past time period, on a wagering game network;

computing an expected value of a prize for the wagering game contest based on the values for the variables and the data for the gaming activity, wherein the expected value represents a theoretical projected amount of money that would be accumulated via a portion of game wagers over a future time period based on the values for the variables and the data for the gaming activity that occurred during the past time period; and funding the prize for the wagering game contest with an amount of money equivalent in value to the expected value, wherein the funding is from a source other than from the portion of the game wagers.

7. The one or more machine-readable storage media of claim 6, wherein the variables comprise one or more events that trigger an outcome for the wagering game contest.

8. The one or more machine-readable storage media of claim 7, wherein said operation for funding the prize for the wagering game contest with the amount of money equivalent in value to the expected value includes operations further comprising:

detecting that the one or more events trigger a winning outcome for the wagering game contest via one or more wagering game elements of a wagering game played during a wagering game session on a wagering game machine, where the wagering game session is associated with a first wagering game user account; and transferring the amount of money equivalent to the expected value from a second wagering game user account to the first wagering game user account, wherein the second wagering game user account is a promotional account associated with a casino.

9. The one or more machine-readable storage media of claim 8, said operations further comprising:

detecting that the one or more events that trigger the outcome for the wagering game contest cause one of the values for the variables to be incalculable; and excluding the one of the values for the variables from the computing the expected value in response to detecting that the one or more events that trigger the outcome for the wagering game contest cause the one of the values for the variables to be incalculable.

10. The one or more machine-readable storage media of claim 7, said operations further comprising:

detecting that the one or more events trigger a plurality of winning outcomes for the wagering game contest via wagering game elements of wagering games played during wagering game sessions on wagering game machines, where the wagering game sessions are associated with a plurality of wagering game user accounts;

awarding prizes to the plurality of wagering game user accounts, wherein the prizes have a combined value equivalent to the expected value.

11. The one or more machine-readable storage media of claim 6, wherein the variables comprise one or more of a gaming contest duration that specifies the future time period, a virtual rake percentage that specifies the portion of the game wagers, and a sampling period that specifies the past time period for the detecting of the data for the gaming activity.

12. The one or more machine-readable storage media of claim 6, wherein the data for the gaming activity comprises one or more of an average number of games played over the past time period, and an average bet amount per game over the past time period.

13. A system comprising:

a gaming contest controller configured to present controls associated with variables of a wagering game contest, wherein the controls are configured to receive values for the variables via user input, detect data for gaming activity for a sampling period on a wagering game network, compute an expected value of an award for the wagering game contest based on the values for the variables and the data for the gaming activity, wherein the expected value represents a theoretical projected amount of money that would be accumulated via a portion of game wagers over a contest time period based on the values for the variables and the data for the gaming activity that occurred during the sampling period, and initiate the wagering game contest, wherein the award for the wagering game contest is funded with an amount of money equivalent to the expected value, and wherein the wagering game contest is funded from a source of money other than from the portion of the game wagers; and a wagering game machine configured to present wagering game content during a wagering game session associated with a wagering game account, cause a wagering game event to occur via the wagering game content, wherein the wagering game event is a winning event for the wagering game contest, and present a message, via the wagering game machine, that the winning event occurred.

14. The system of claim 13, wherein the sampling period is one of the variables and wherein one of the controls is configured to receive a value for the sampling period via the user input.

15. The system of claim 13, wherein the wagering game event is one of the variables and wherein one of the controls is configured to receive a value for the wagering game event via the user input.

16. The system of claim 13, wherein the gaming contest controller is further configured to present additional controls that specify one or more of an event type and a game type associated with the wagering game event.

17. The system of claim 13, wherein the variables comprise one or more of a gaming contest duration that specifies the future time period, a virtual rake percentage that specifies the portion of the game wagers, and a sampling period that specifies the past time period for the detecting of the data for the gaming activity, and wherein the data for the gaming activity comprises one or more of an average number of games played over the past time period, and an average bet amount per game over the past time period.

18. An apparatus comprising:

a processor; and a gaming contest controller configured to, via the processor, present controls associated with variables of a wagering game contest, wherein the controls are configured to receive values for the variables via user input, detect data for gaming activity for a sampling period on a wagering game network, compute an expected value of a prize for the wagering game contest based on the values for the variables and the data for the gaming activity, wherein the expected value represents a theoretical projected amount of money that would be accumulated via a portion of game wagers over a contest time period based on the values for the variables and the data for the gaming activity that occurred during the sampling period, and initiate the wagering game contest, wherein the prize for the wagering game contest is funded with an amount of money equivalent to the expected value, and wherein the prize for the wagering game contest is funded from a source of money other than from the portion of the game wagers.

19. The apparatus of claim 18, wherein the contest time period is a projected time period for the contest to run and the sampling period if a past time period for the detecting of the data for the gaming activity.

20. The apparatus of claim 18, wherein the variables comprise the contest time period, the sampling period, and a virtual rake percentage that specifies the portion of the game wagers that would be extracted during the contest time period, and wherein the data for the gaming activity comprises an average number of games played over the sampling period, and an average bet amount per game over the sampling period.

21. The apparatus of claim 20, wherein the gaming contest controller is further configured to compute the expected value by multiplying the average number of games played, the average bet amount per game, the contest time period, and the virtual rake percentage.

22. An apparatus comprising:

means for detecting values for all but one of a plurality of variables for a wagering game contest, wherein the plurality of variables comprise one or more of a wagering game contest duration, a value for a virtual rake percentage, a value for a sampling period, a virtual expected value, and a value for a gaming event;

means for detecting data for gaming activity that occurred during the sampling period, wherein the sampling period specifies a past time period for detecting of the data for the gaming activity;

means for computing the virtual expected value for the one of the plurality of the variables using the values for all but one of the plurality of variables; and means for funding a prize for the wagering game contest with an amount of money equivalent to the virtual expected value using a source of money other than from wagers from wagering games played during the wagering game contest.

23. The apparatus of claim 22 wherein the value for the gaming event indicates a winning outcome for the wagering game contest, wherein the gaming event occurs via at least one wagering game from a plurality of wagering games played during a wagering game session, wherein the wagering game contest duration specifies a future time period over which the wagering game contest runs, wherein the rake percentage specifies a theoretical portion of game wagers that would be extracted from the plurality of wagering games over the wagering game contest duration, and wherein the virtual expected value represents a projected amount of money that would be accumulated via a portion of game wagers over the wagering game contest duration based on the plurality of the variables values for data for the gaming activity that occurred during the sampling period.

24. The apparatus of claim 23, wherein the gaming activity comprises an average number of games played over the sampling period, and an average bet amount per game over the sampling period.

* * * * *